US005887785A

United States Patent [19]

Yilmaz

[11] Patent Number: 5,887,785

[45] Date of Patent: Mar. 30, 1999

[54] APPARATUS FOR QUALITATIVE AND QUANTITATIVE AIR MANAGEMENT FOR CEILING FANS

[76] Inventor: G. George Yilmaz, 28202 Meadowlark La., Bonita Springs, Fla. 34134

[21] Appl. No.: 874,195

[22] Filed: May 27, 1997

[51] Int. Cl.[6] ..... F24F 7/00; B01D 19/00; B63H 1/00

[52] U.S. Cl. ..... 237/1 R; 237/46; 416/62; 55/467

[58] Field of Search ..... 237/1 R, 46; 416/5, 416/62; 55/467

[56] References Cited

U.S. PATENT DOCUMENTS

| | | | |
|---|---|---|---|
| 4,422,824 | 12/1983 | Eisenhardt | 416/5 |
| 4,753,573 | 6/1988 | McKnight | 416/62 |
| 4,840,650 | 6/1989 | Matherne | 55/385.1 |
| 4,889,543 | 12/1989 | Burt | 55/97 |
| 5,022,819 | 6/1991 | Murcin et al. | 416/62 |
| 5,383,765 | 1/1995 | Baxter et al. | 416/62 |
| 5,562,412 | 10/1996 | Antonelli | 416/62 |
| 5,624,230 | 4/1997 | Taylor et al. | 416/5 |
| 5,668,920 | 9/1997 | Pelonis | 392/361 |

*Primary Examiner*—William Doerrler
*Attorney, Agent, or Firm*—Merrill N. Johnson

[57] ABSTRACT

The present invention improves both the quality and the flow of air delivered by a ceiling fan. Ceiling fans provide limited indoor air flow, but do not function as air quality improvement apparatus. The present invention provides all ceiling fans with an ability to increase indoor air quality where they operate. One or a combination of a physical/chemical filter, an electrostatic particulate matter remover, a heating unit, and a secondary multidirectional fan provide consumers with air quality improvement options for ceiling fans to fulfill their specific needs for a given area.

4 Claims, 3 Drawing Sheets

APPARATUS FOR QUALITATIVE AND QUANTITATIVE AIR MANAGEMENT FOR CEILING FANS

FIELD OF THE INVENTION

The present invention lies in the field of environmental engineering and more particularly to improve both the quality and the flow of air delivered by a ceiling fan. The fan light fixture connection port on a ceiling fan is utilized for the apparatus which includes mechanical and electrical connections. The present invention will provide the occupants of an indoor facility with improved air quality.

BACKGROUND OF THE INVENTION

There is a need for an apparatus which will improve the quality of air delivered by a ceiling fan. Currently, ceiling fans provide limited indoor air flow, and do not function as air quality improvement apparatus. The present invention provides ceiling fans with an ability to improve indoor air quality where they operate. The apparatus can be connected to a ceiling fan by using the light fixture connection port of said ceiling fan. Therefore the present invention will provide consumers with improved quality of air delivered by ceiling fans.

SUMMARY OF THE INVENTION

The present invention lies in the field of environmental engineering and more particularly to improve the quality of air delivered by ceiling fans. Ceiling fans only provide limited indoor air flow and do not function as air quality improvement apparatus. The present invention provides ceiling fans with an ability to improve indoor air quality where they operate. The apparatus can be easily connected to a ceiling fan by using the fan light fixture connection port of said fan which provides mechanical and electrical connections. The electrical connections are needed for powering the apparatus which includes one or a combination of an electric heating unit, a secondary fan, an electrostatic fugitive particulate matter remover, and a chemical/physical filter. A physical/chemical filter is to trap dust, particulate matter, and contaminants such as Volatile Organic Carbons (VOCs). An electrostatic filter is to attract and collect fugitive particulate matter. An electric heating unit is to condition the temperature of air. A secondary fan is to improve air flow to desired patterns for efficiency.

The present invention will provide occupants of an indoor facility or household with air quality and quantity improvement options to fulfill their specific needs for a given area. The same apparatus will also provide consumers with a fan light fixture connection port.

DETAILED DESCRIPTION OF THE PREFERRED EMBODIMENTS

Figure 2:
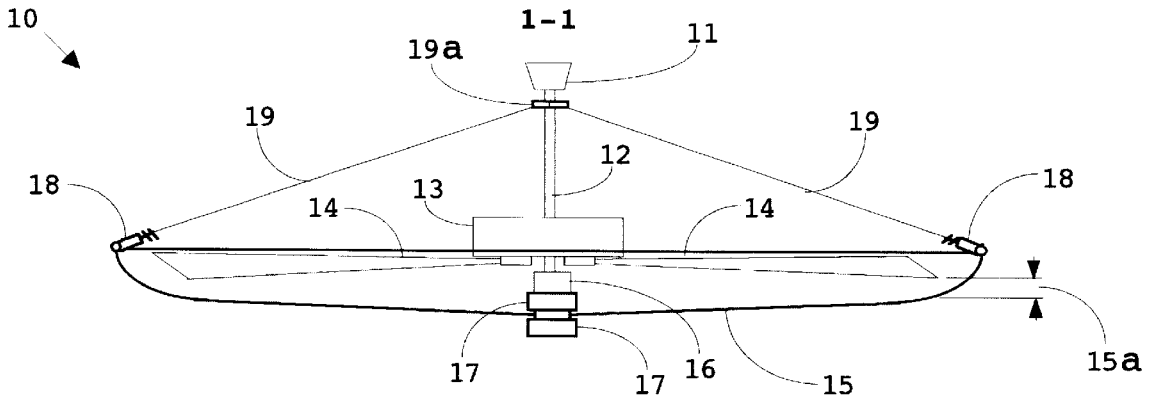
FIG. 2 shows detailed description of the apparatus including an electrostatic fugitive particulate matter remover for ceiling fans.
Figure 1:
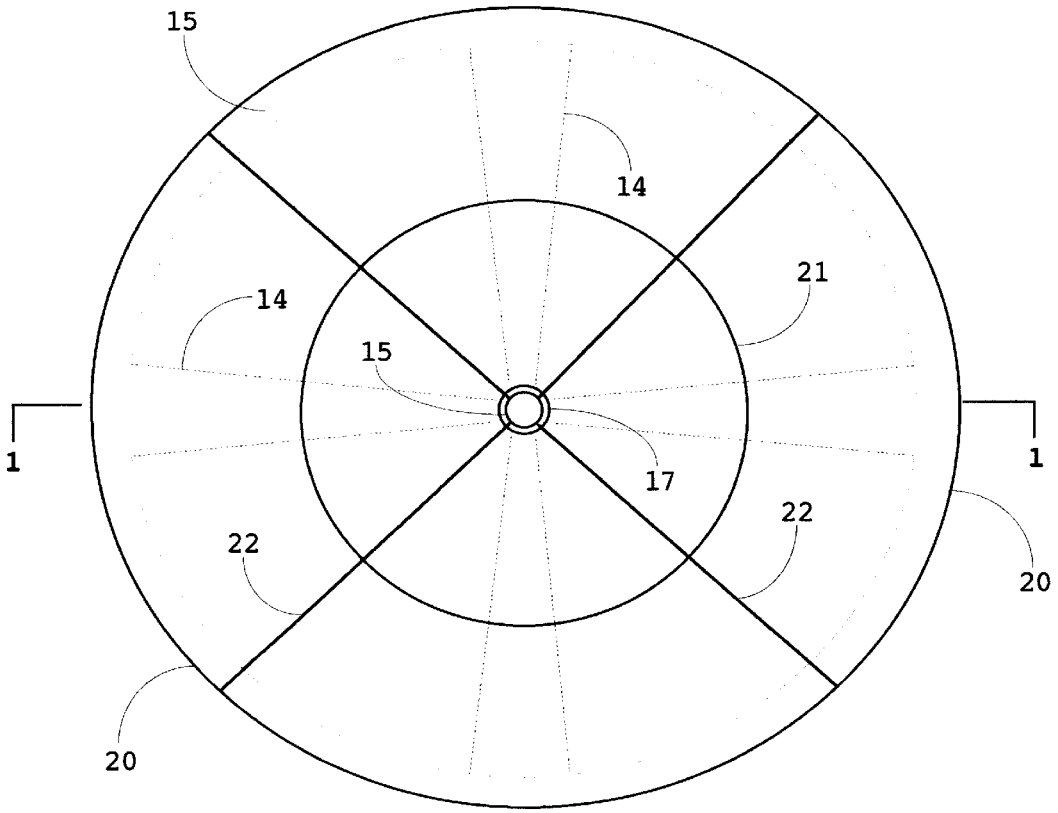
FIG. 1 shows detailed description of the apparatus including physical and/or chemical filters for ceiling fans.

FIG. 1 and 2 show a typical ceiling fan and the preferred embodiment of the apparatus 10 including physical/chemical filter 15. A typical ceiling fan includes roof connection box 11, fan rod 12, fan motor unit 13, fan blades 14, and the fan light fixture connection port 16 which comes with ceiling fans. A fan light fixture connection port 16 includes mechanical connections as well as male and/or female cable plugs which are designed to deliver electric power to a light fixture. A physical and/or chemical filter 15 is connected to a ceiling fan utilizing said fan light fixture connection port 16 using a main connector 17 at the center. Both sides of said main connector 17 permit attachments and either side of said main connector 17 allows connections to a ceiling fan light fixture connection port 16. Tension cables/rods 19 are connected to both an elastic perimeter filter bar 20 and a ceiling fan rod 12 using adjustable connectors 18 and self locking connectors 19*a* respectively. Said preferred connections allow adjustments and have filter 15 work with fan rod 12 in a harmony along the axis of fan rod 12. Said preferred connections also position physical/chemical filter 15 parallel to fan blades 14 therefore securing a necessary fan blade clearance 15*a*. A physical and/or chemical filter 15 is to trap fugitive dust, particulate matter, and contaminants such as Volatile Organic Carbons (VOCS) in air while it is circulated as delivered by a ceiling fan. The structural integrity of a filter 15 is accomplished by a number of parallel and diagonal elastic bars such as 20 and 21 and 22 depending on the size/diameter of fan blade clearances.

Figure 4:
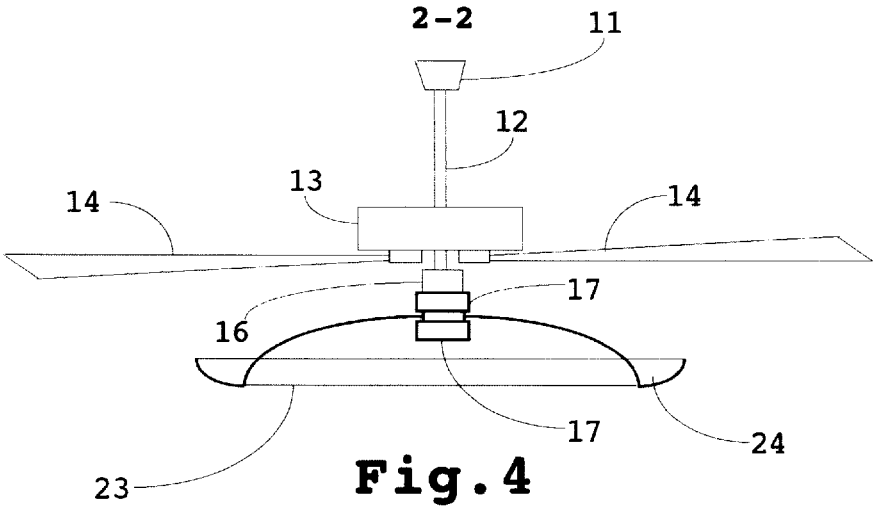
FIG. 4 shows a cross section 2—2 of FIG. 3 including main connector and electrostatic filter for fugitive particulate matter removal for ceiling fans.
Figure 3:
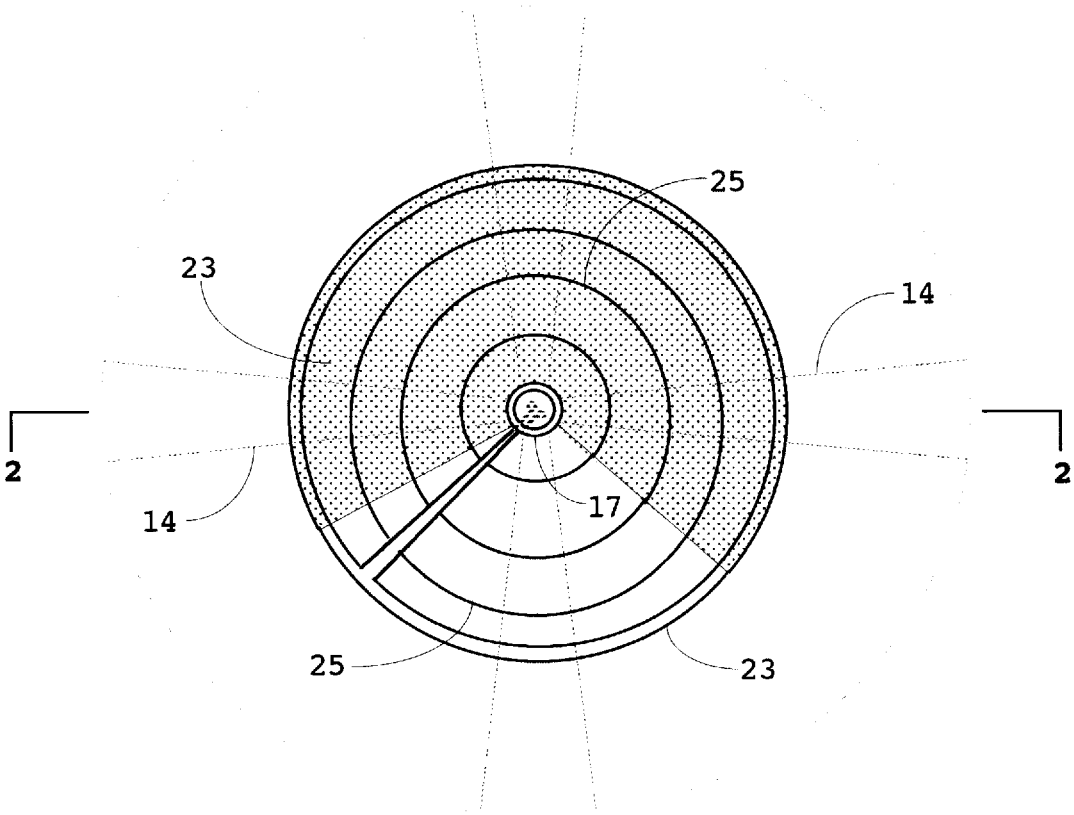
FIG. 3 shows detailed description of the apparatus including a heating unit and a secondary fan, and complementary ceiling fan blade filters cross section.

FIGS. 3 and 4 show an electrostatic filter 23 including main connector 17. Fugitive dust/particulate matter is attracted to 23 by using induced potential energy difference between filter 23 and fugitive dust/particulate matter. The potential energy difference is preferred to be generated by using electric energy which is available in a ceiling fan connection port 16. The electric energy is delivered through a main connector 17, and it is applied to an electrostatic grid 25 which is also attached to filter 23. As a result, opposite charged fugitive particulate matter is attracted to said electrostatic grid 25 and filter 23. Most of the fugitive particulate matter is collected in pocket 24 due to air flow dynamics.

Figure 6:
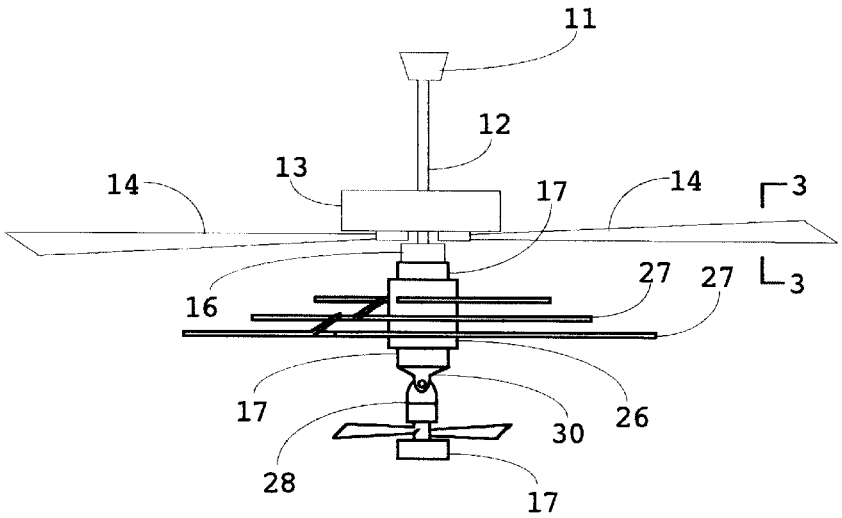
FIG. 6 shows a heating unit and a secondary fan and universal joint connected to main connector.
Figure 7:
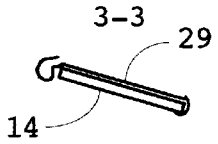
FIG. 7 shows complementary ceiling fan blade filters connected to a fan blade.
Figure 5:
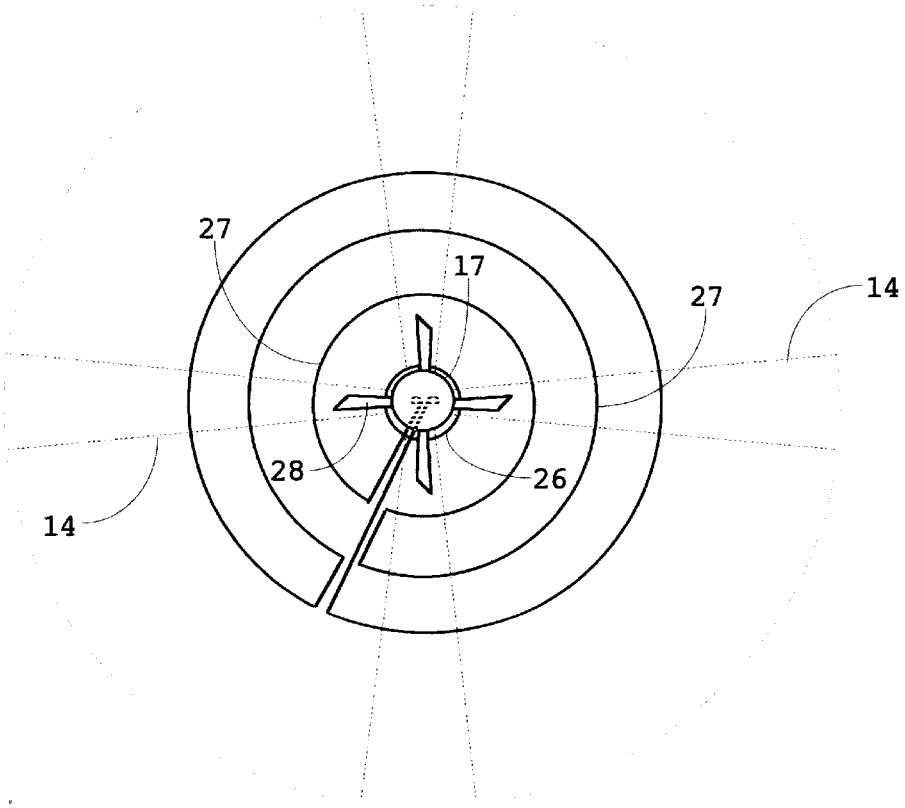
FIG. 5 shows detailed description of the apparatus including a heating unit and a secondary fan.

FIG. 5 and 6 show a heating unit 26 and its heating elements 27. Said heating unit 26 is connected to a fan light fixture port 16 using a main connector 17. FIG. 3 also shows a secondary fan 28 which is connected to heating unit 26 using a main connector 17. Heating unit 26 and secondary fan 28 are powered by electric energy transmitted by main connectors 17 which are connected to available electric energy from a ceiling fan light fixture port 16. An alternative ceiling fan air filter 29 fit fan blades 14 as shown in cross section 3—3 of FIG. 7. Ceiling fan blade filters 29 are used to supplement and complement filters 15 and 23 and they can be used as needed.

A secondary fan 28 as shown in FIG. 3 is to improve air flow patterns to optimize the efficiency of filters 15 and 23 as well as heating unit 26. Said heating unit 26 is to condition air in terms of temperature to more desired levels to supplement other means of indoor heating. Since air near ceilings have relatively higher temperature than air near floors, the efficiency of ceiling fan heating unit 26 would be higher. The secondary multidirectional fan 28 with a self locking universal joint 30 can also be used to manage the direction of the air flow delivered by a ceiling fan to cover areas where ceiling fan can not generate strong enough air circulation alone.

One or a combination of a physical/chemical filter 15, an electrostatic particulate matter remover 23, a heating unit 26, and a secondary fan 28 as described above will provide consumers with air quality improvement options for ceiling fans to fulfill their specific needs for a given area.

While I have fully shown and described embodiments of my apparatus for qualitative and quantitative air management for ceiling fans no limitations as to the scope of the present invention should be implied from the foregoing description. The true scope of the present invention is limited only by the following claims.

I claim:

1. An apparatus for qualitative and quantitative air management for ceiling fans which fans include a light fixture connection port comprising a main connector which includes attachments which are connected to a ceiling fan by said attachments to the light fixture connection port of the ceiling fan, an air filter which is connected to said main connector and extends to cover a desired space, and an electrostatic filter which is electrically powered by connection to said main connector.

2. Apparatus as set forth in claim 1 which include a multidirectional secondary fan which includes a self locking universal joint both sides of which are connected to said main connector.

3. Apparatus as set forth in claim 1 which include a heating unit both sides of which are connected to said main connector.

4. Apparatus as set forth in claim 1 which include a complementary air filter attached to each blade of a ceiling fan.

* * * * *